US008138878B2

(12) United States Patent
Hundt et al.

(10) Patent No.: US 8,138,878 B2
(45) Date of Patent: Mar. 20, 2012

(54) CURRENT-COMPENSATED CHOKE AND METHOD FOR PRODUCING A CURRENT-COMPENSATED CHOKE

(75) Inventors: Harald Hundt, Dieburg (DE); Hartmut Schoenbohm, Erlensee (DE); Dieter Proksch, Karlstein (DE); Klemens Trabold, Elsenfeld (DE); Michael Engelstädter, Sellgenstadt (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 172 days.

(21) Appl. No.: 12/642,537

(22) Filed: Dec. 18, 2009

(65) Prior Publication Data

US 2010/0156586 A1 Jun. 24, 2010

(30) Foreign Application Priority Data

Dec. 18, 2008 (DE) ..... 10 2008 054 939

(51) Int. Cl.
*H01F 27/24* (2006.01)
*H01F 27/30* (2006.01)
*H01F 5/00* (2006.01)
*H01F 7/06* (2006.01)

(52) U.S. Cl. ..... 336/229; 336/83; 336/198; 336/200; 29/602.1

(58) Field of Classification Search ..... 336/229, 336/212, 180, 183, 198, 200, 223, 232; 29/602.1
See application file for complete search history.

(56) References Cited

U.S. PATENT DOCUMENTS 1,199,092 A * 9/1916 Mack ..... 336/82
2,862,194 A * 11/1958 Bany et al. ..... 336/173
4,160,966 A * 7/1979 Kennedy ..... 336/155
4,623,865 A 11/1986 Kiesel et al.
5,430,613 A * 7/1995 Hastings et al. ..... 361/760
5,581,224 A * 12/1996 Yamaguchi ..... 336/212
6,262,651 B1 7/2001 Miyamoto et al.
6,456,182 B1 9/2002 Katayama et al.
7,023,317 B1 4/2006 Herbert
7,280,025 B2 * 10/2007 Sano ..... 336/200
7,990,248 B2 8/2011 Feist et al.

FOREIGN PATENT DOCUMENTS

DE 1 613 570 1/1972
DE 8520461 10/1985
DE 299 08 197 U1 12/1999
DE 10 2005 006 344 A1 8/2006

(Continued)

OTHER PUBLICATIONS

Office Action issued in connection with German Application No. 10 2008 054 939.8-34, dated Jun. 22, 2009 and translation of the same.

(Continued)

*Primary Examiner* — Anh Mai
(74) *Attorney, Agent, or Firm* — Buchanan, Ingersoll & Rooney, PC

(57) ABSTRACT

The invention relates to a current-compensated choke with a ring core at least two coils composed in each case of the same number of windings, wherein in the interior of the ring core a non-conductive body is arranged with holes embodied in pairs in a mirror symmetrical manner to a symmetry axis of the ring core, wherein respectively one winding is guided through each hole of at least some of the pairs of symmetrical holes, and windings corresponding to one another of different coils are guided through the two holes comprising a pair, and a method for producing a current-compensated choke of this type.

26 Claims, 2 Drawing Sheets

FOREIGN PATENT DOCUMENTS

| | | | | |
|---|---|---|---|---|
| DE | 202006016429 | U1 | | 2/2007 |
| EP | 0 175 069 | A1 | | 3/1986 |
| EP | 1 367 612 | A1 | | 12/2003 |
| EP | 1933339 | A2 | | 6/2008 |
| FR | 2 721 137 | A1 | | 12/1995 |
| JP | 04011710 | A | * | 1/1992 |
| WO | WO9812718 | | | 3/1998 |
| WO | WO0025329 | | | 5/2000 |
| WO | WO 2006/064499 | A2 | | 6/2006 |
| WO | WO 2007/038309 | A2 | | 4/2007 |

OTHER PUBLICATIONS

Carr, "Building Your Own Toroid Core Inductors and RF Transformers", Elektor Electronics, Feb. 1994, pp. 52-58, vol. 20, No. 219, Dorchester, GB.

European Search Report corresponding to EP 09 17 8355 mailed Nov. 24, 2011.

English-Language Translation of European Search Report corresponding to EP 09 17 8355 mailed Nov. 24, 2011.

* cited by examiner

CURRENT-COMPENSATED CHOKE AND METHOD FOR PRODUCING A CURRENT-COMPENSATED CHOKE

This application claims benefit of the filing date of German Application No. DE 10 2008 054 939.8-34, filed Dec. 18, 2008, the entire contents of which are incorporated herein by reference.

BACKGROUND

1. Field

Disclosed herein is a current-compensated choke having a ring core and at least two coils each having the same number of windings, and a method for producing a current-compensated choke of this type.

2. Description of Related Art

Chokes are inductive components in electrical engineering and electronics, which are used among other things in the suppression of interference pulses. A very widespread subtype of suppressor chokes, for example, for suppressing interference currents that occur in the same direction in the outgoing lead and the return line, are current-compensated chokes, which are also known as "common mode chokes." Current-compensated chokes are characterized by several, but at least two coils, which are flowed through in the opposite direction by operating current. As a result, with ideal coils, i.e., coils that are completely symmetrical to one another with the same number of windings, the same sector and the same wire guide, the magnetic fields of the coils in the core of the choke cancel one another, so that the choke has a low inductance for the operating current, while the inductance of the choke for the interference currents occurring in the same direction is high. Deviations from an ideal, completely symmetrical coil lead to losses with the increasing frequency of the operating current, which losses are to be kept as low as possible.

The design of current-compensated chokes is subject to a number of geometric and electromagnetic conditions. In order to keep the ohmic losses low, the wires used for the coil are selected to be as thick as possible. In order to achieve high inductances for interference currents in the same direction, the winding is carried out as a rule on a toroidal magnetic core, which should be as small as possible, however, because of various installation conditions. However, at the same time the individual coil should thereby comprise as many windings as possible. The galvanic isolation between the coils is also essential. Wires of the individual coils, the windings of which all have to be guided through the center hole of the toroidal magnetic core, must therefore be prevented from touching one another.

These geometric and electromagnetic conditions generally make it necessary to wind current-compensated chokes by hand or using hand operated mechanical traction devices and similar mechanical aids, e.g., crochet needles. However, it is virtually impossible to achieve exactly symmetrical coils with a manual winding technique of this type. Despite the high production expense, cross-overs between the wires of individual windings and inaccuracies in the guide of the wires can often occur.

Accordingly, there remains a need to improve the symmetry of the coils with a current-compensated choke without increasing expense.

SUMMARY

One or more of these advantages are achieved by the various embodiments disclosed herein. An embodiment of a current-compensated choke described herein comprises a ring core and an even number of, but at least two, coils composed in each case of the same number of windings, wherein further in the interior of the ring core a non-conductive body is arranged with holes embodied in pairs in a mirror symmetrical manner to a symmetry axis of the ring core. Respectively one winding is thereby guided through each hole of at least some of the pairs of symmetrical holes, and windings corresponding to one another of coils assigned to one another are guided through the two holes comprising a pair.

More particularly, an embodiment of a current-compensated choke disclosed a current-compensated choke comprising: a ring core, comprising a solid ring having an outer circumference and an inner circumference surrounding an interior space; at least a first coil and a second coil each of which are wound about the ring core, and each comprising the same number of windings of a conductor; and a non-conductive body disposed within the interior space of the ring core and provided with a first set of holes and a second set of holes, each hole extending from a first surface to a second surface of the non-conductive body, wherein each hole of the first set of holes opposes a corresponding hole of the second set of holes to form opposing pairs in a mirror symmetrical manner relative to a symmetry axis of the ring core, wherein at least one winding of the first coil passes through one of the first set of holes, and at least one winding of the second coil passes through one of the second set of holes forming an opposing pair with the hole of the winding of the first coil.

The ring core thereby serves as a carrier structure onto which the coils are applied directly or indirectly.

In another embodiment is described a method for providing a current-compensated choke, comprising:

a) providing a ring core having an interior space containing a non-conductive body disposed therein, the non-conductive body comprising a first set of holes and a second set of holes, each hole extending from a first surface to a second surface of the non-conductive body, wherein each hole of the first set of holes opposes a corresponding hole of the second set of holes to form opposed pairs in a mirror symmetrical manner relative to a symmetry axis of the ring core, wherein the holes lying on a first side of the symmetry axis form a first group and the holes lying on a second side of the symmetry axis form a second group, b) guiding a first end of a first wire section through a first hole of the first group, c) guiding a second end of the first wire section in a loop enclosing the ring core through a a second hole of the first group, wherein the first end of the first wire section is guided through the first hole in a direction opposite to the direction in which the second end of the first wire section is guided through the second hole, d) guiding a first end of a second wire section through a first hole of the second group, e) guiding a second end of the second wire section in a loop enclosing the ring core through a second hole of the second group, wherein the first end of the second wire section is guided through the first hole in a direction opposite the direction in which the second end of the second wire section is guided through the second hole, f) applying a tensile force to the first wire sections after c), d), or e) and applying a tensile force to the second wire section after d) or e)

The tensile force can be applied to the first wire section either before or after the guiding of the second wire section through the holes.

BRIEF DESCRIPTION OF THE DRAWINGS

Various specific embodiments are described in more detail below based on the exemplary embodiments shown in the figures of the drawing; unless stated otherwise, identical components are labeled in all of the figures with the same reference numbers.

DETAILED DESCRIPTION OF SPECIFIC EMBODIMENTS

Figure 1:
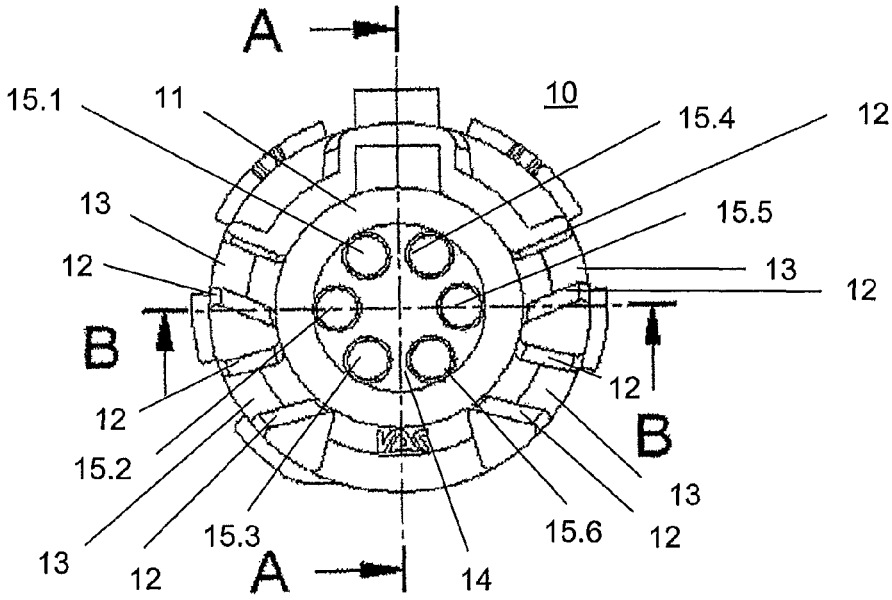
FIG. 1 is a front view of a choke body of an embodiment of a current-compensated choke described herein.

As used herein, the term "coils assigned to one another" means the coils with magnetic fields which are to compensate one another respectively when the coils are flowed through with the operating current, thus which ideally are designed completely symmetrically to one another. This symmetry also establishes which windings of the coils correspond to one another; in general, however, this correspondence can also be determined by counting in the same direction the windings of coils corresponding to one another. In the case of symmetrical coils with N windings, the windings that are assigned the same ordinal number n where $1 \leqq n \leqq N$ during counting will thereby correspond to one another.

It is therefore provided, according to the embodiments disclosed herein, to exactly stipulate the course of the individual windings in each case, in that their starting point and ending point are established in a defined manner and so that each winding is tightened as it is created or after only one or two additional windings are created. Through the tightening of the individual windings in the course of the production process, the shortest possible connection is then produced, taking into account the geometric conditions. In the case of a symmetrical arrangement of the holes in pairs and the stipulation of the same geometric conditions for these pairs of holes, in particular through the geometry of the ring core and the geometric embodiment of the non-conductive body, the exact symmetry of the individual windings assigned to one another of the coils compensating one another and thus symmetry of the total coils is thereby guaranteed. In particular, an undesired crossing of coils is reduced or excluded.

A particularly simple embodiment of the non-conductive body is a disk arranged in the interior of the ring core, that is, a disk with a smaller radius than the internal radius of the ring core, the planar, circular area of which disk runs parallel to the direction in which an internal radius vector of the ring core extends.

It has furthermore proven to be advantageous in certain embodiments to enclose the ring core with a plastic body composed of at least two parts. Through this measure, an improved stability of the choke body then formed by the ring core and plastic body with respect to the high tensile forces applied, in particular with the use of thick wires for the coils in the production of the choke, can be achieved in a simple manner. Moreover, the effects of environmental influences on the ring core is reduced thereby.

In this case, a very simple assembly of the current-compensated choke is possible when the non-conductive body is connected to one of the parts of the assembled plastic body or is a component of one of the parts of the assembled plastic body which encloses the ring core. An embodiment of the plastic body that is simple to produce lies in particular in an embodiment as two toroidal half-shells that accommodate or enclose the ring core.

Enclosing the ring core in a plastic body having two half-shells which overlap such that they are guided in the inner and outer circumference in a positive manner is particularly effective in protecting the ring core against environmental influences, which with local interaction with parts of the ring core at the respective points could change the magnetic properties thereof and thus impair the function of the current-compensated choke.

Depending on the use, it can be advantageous if: the half shells of the plastic body are connected to one another by an ultrasonic welded seam, which leads to optimum sealing, or when the half shells of the plastic body can be screwed to one another by means of cooperating threads applied on each side, which makes it possible to subsequently open the plastic body, or when the two half shells of the plastic body are connected to one another by a locking mechanism, which makes possible a particularly simple and cost-effective production.

In a particularly advantageous embodiment, guide elements for guiding and separating the windings are arranged on the surface of the plastic body and/or guide elements are inserted into the surface of the plastic body. It is thereby possible to influence the geometric conditions and thus the course of the windings as desired, whereas without guide elements of this type, the shortest connection on the surface of the choke body between the output side of a hole, at which the winding in question begins, and the input side of the next hole, at which it ends, always determines the course of the winding. The guide elements can be realized in particular embodiments as ridges, grooves or a combination of ridges and grooves.

The preferred material for the plastic body is a high-temperature resistant plastic, in particular polyether ether ketone (PEEK) or polyphenylene sulfide (PPS).

The production of the current-compensated choke is particularly simple when the holes in the non-conductive body in at least one direction have an insertion aid conically tapering from the surface of the non-conductive body in the extension direction of the hole.

Due to the magnetic properties that are advantageous for most applications, the preferred material for the ring core of the current-compensated choke is a soft magnetic strip and in particular a soft magnetic strip that contains an amorphous or nanocrystalline alloy. In certain embodiments, the ring core can have an external diameter of at least 20 mm, for example.

Due to its good conduction properties in particular, copper wire has proven to be useful as a material for the coils of certain embodiments of a current-compensated choke of this type. In particular embodiments, the copper wire is preferably varnished and/or has a high-temperature resistant insulation, in particular polyester imide (PEI) or polyimide (PI). In order to be able to conduct the currents occurring in typical cases of use in a low-loss manner, in certain embodiments the copper wire can have a diameter of more than 2 mm.

To insulate the current-compensated choke to the outside, in particular in embodiments using uncoated copper wire, the provision of an insulating coating of a thickness of between 5 and 200 μm (e.g., 5 to 50 μm or 50 to 200 μm) can be advantageous. Such a coating can be obtained, for example, by spraying or dip coating during the production of the current-compensated choke.

The method for producing a current-compensated choke described herein has at least the steps a) Fixing a ring core, which has in its interior a non-conductive body with holes embodied in pairs in a mirror symmetrical manner to a symmetry axis of the ring core, wherein the holes lying on the one side of the symmetry axis form a first group and the holes lying on the second side of the symmetry axis form a second group, b) Guiding a wire section through one of the holes of one of the groups, c) Guiding at least one of the ends of the wire section in a loop enclosing the ring core through a further hole of the same group, wherein the first end of the wire section is guided through holes in the opposite direction to the second end and d) Repeating steps b) and c) for the other group with a further wire section, wherein furthermore either a tensile force is applied to each of the wire sections after steps c) and d) have been carried out or a tensile force is applied to the corresponding wire section after step c) has been carried out.

The method described herein produces a current-compensated choke in a safe and reproducible manner, in which it is ensured that the choke has virtually identical coils in a very good approximation to symmetrical, so that the losses in the current-compensated choke are also significantly reduced, specifically with the use of high-frequency operating current. While not wishing to be bound by theory, it is believed that these advantages are obtained because when the holes are set in the non-conductive body, through which holes the one given winding is guided, through geometric constraints the course that the winding adopts upon placing tensile force on the wire segment, and thus the course of the coil around the ring core, is clearly predetermined. A symmetrical arrangement of the holes through which the windings of the one or the other coil are guided, with identical geometric conditions for the individual windings, is ensured by the ring core and the form of the non-conductive body. This automatically leads to symmetrical coils, as long as the given coil in both cases is guided through corresponding pairs of holes. In particular the crossover of windings can be caused only deliberately through the selection of corresponding hole combinations for the course of the windings crossing over one another and is otherwise excluded.

The use of a tensile force on both sides is very advantageous, since this ensures that all of the windings that are exposed to the tensile force are tightened to approximately the same extent. This is particularly relevant because an adequate tensile force has to be applied in order to impress the course predetermined by the geometric constraints onto the winding material of each of the windings. In the case of very inhomogeneous tension on the individual windings, a much higher load than the adequate tensile force occurs at some points of the ring body, which can lead to the fracture thereof at the points in question.

A method with particularly few steps is obtained when the tensile force is applied after the wire section has been guided through all of the holes belonging to one group or through all of the holes belonging to both groups. However, high tensile forces are necessary for this.

If the aim is to minimize the required tensile forces, which is the case in particular with the use of very thick wires as a material for the coils, it is advantageous if the tensile force is applied in each case when the wire section was guided through another hole.

FIG. 1 shows a choke body 10 according to an embodiment disclosed herein, that is, the unwound choke, in front view. A first half shell 11 of a plastic body is shown, which half shell has ridges 12 and indentations 13. A non-conductive body 14 embodied as a disk is connected in one piece to the half shell 11, the visible upper circle area of which body runs parallel to an interior radius vector (not shown) of a ring core 23, hidden by the first half shell 11 in FIG. 1, but discernible in FIGS. 2 and 3. The non-conductive body 14 is penetrated by holes 15.1, 15.2, 15.3, 15.4, 15.5 and 15.6 in the line of sight. The holes 15.1 through 15.3 form a first group of holes, the holes 15.4 through 15.6 form a second group of holes, which are arranged symmetrically to the first group of holes 15.1 through 15.3 with respect to the symmetry axis A-A. The holes 15.1 and 15.4, 15.2 and 15.5 and 15.3 and 15.6 are thereby respectively symmetrical to one another in pairs and thus form pairs of symmetrical holes. Apart from the symmetry axis A-A, a section axis B-B is also shown, which clarifies the section shown in FIG. 3.

Figure 2:
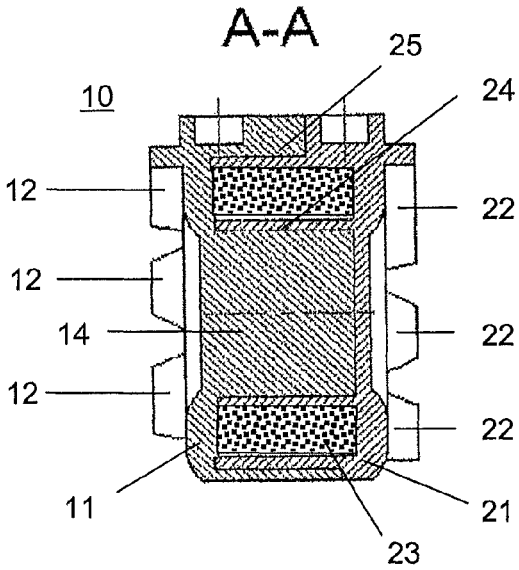
FIG. 2 is a sectional view of the choke body of FIG. 1 along the section line A-A.

FIG. 2 shows a section through the choke body 10 from FIG. 1 along the symmetry axis and section line A-A. In turn the first half shell 11 is shown, the sectional area of which is shown here by hatching from top left to bottom right, as well as the ridges 12 of the first half shell and the non-conductive body 14 embodied in one piece with the first half shell 11 and as a disk and therefore likewise hatched. Furthermore, a second half shell 21 is shown, the sectional area of which is shown here by hatching from top right to bottom left, and has ridges 22. The first and second half shell 11, 21 enclose the ring core 23, namely such that they are respectively guided in a positive manner on the inner circumference 24 and on the outer circumference 25. It is to be noted that the nonconductive body 14 has been illustrated as attached to first half shell 11, but that other arrangements are possible; for example it could have been attached to second half shell 21, or introduced as a separate piece.

Figure 3:
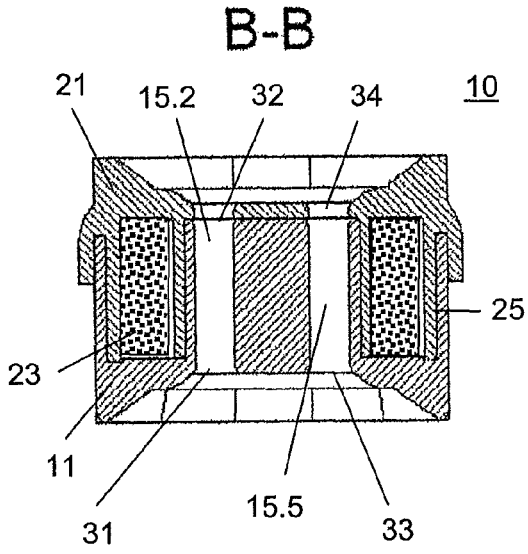
FIG. 3 is a sectional view of the choke body of FIG. 1 along the section line B-B, and FIG. 4 a front view of a choke comprising the choke body of FIG. 1 provided with coils.

FIG. 3 shows a section through the choke body 10 from FIG. 1 along the section line B-B. As in FIG. 2, the first half shell 11 is discernible, the sectional area of which is also shown here by hatching from top right to bottom left, as well as the non-conductive body 14 embodied in one piece with the first half shell 11 as a disk and therefore likewise hatched, and the second half shell 21, the sectional area of which is shown here by hatching from top left to bottom right. The first and second half shell 11, 21 enclose the ring core 23 such that they are guided in each case in a positive manner on the inner circumference 24 and on the outer circumference 25. In addition, in FIG. 3 the holes 15.2 and 15.5 are also discernible, which penetrate the non-conductive body 14 embodied as a disk. At the input and output of the holes, the holes respectively have insertion aids 31, 32, 33, 34 conically tapering from the surface of the non-conductive body 14 in the direction of extension of the hole.

The method according to the invention is explained by way of example based on FIGS. 1 through 3. First a choke body 10, as is shown in FIGS. 1 through 3, and thus the ring core 23 contained therein are provided. Then a wire section is guided through the hole 15.2 in a direction opposite the line of sight of FIG. 1. The insertion operation is thereby facilitated by the insertion aid 31. The end of the wire section exiting from the hole 15.2 in the representation of FIG. 1 opposite the line of sight is then guided in a loop enclosing the ring core, thus from the side of the non-conductive body 14 that is not visible in FIG. 1, passes through the hole 15.1. The end of the wire section exiting from the hole 15.2 in the same direction as the line of sight in the representation of FIG. 1 is guided in a loop enclosing the ring core, thus from a side of the non-conductive body 14 that is visible in FIG. 1, passes through the hole 15.3. If a tensile force is now applied on both sides to the wire section, the loops, guided through the ridges 12 and indentations 13 that are placed around the coil, form as windings of a coil.

Subsequently, a second wire section is guided through the hole 15.5 in a direction opposite the line of sight of FIG. 1. The insertion operation is thereby facilitated by the insertion aid 33. The end of the wire section exiting from the hole 15.5 in a direction opposite the line of sight in the representation of FIG. 1 is then guided in a loop enclosing the ring core, thus from the side of the non-conductive body 14 that is not visible in FIG. 1, passes through the hole 15.4. The end of the wire section exiting from the hole 15.5 in the same direction as the line of sight in the representation of FIG. 1 is guided in a loop enclosing the ring core, thus from the side of the non-conductive body 14 that is visible in FIG. 1, through the hole 15.6. If a tensile force is now applied to the wire section on both sides, the loops, guided through the ridges 12 and indentations 13, that are placed around the coil, form as windings of a coil. The coils with multiple windings can thus be produced respectively by a single tensile force operation.

Of course, a one-sided tensile force could also be applied, the tensile force could already be applied after one of the individual loops has been placed or after the loops have been placed for both wire sections the tensile force could be applied at the same time or consecutively to these wire sections.

Figure 4:
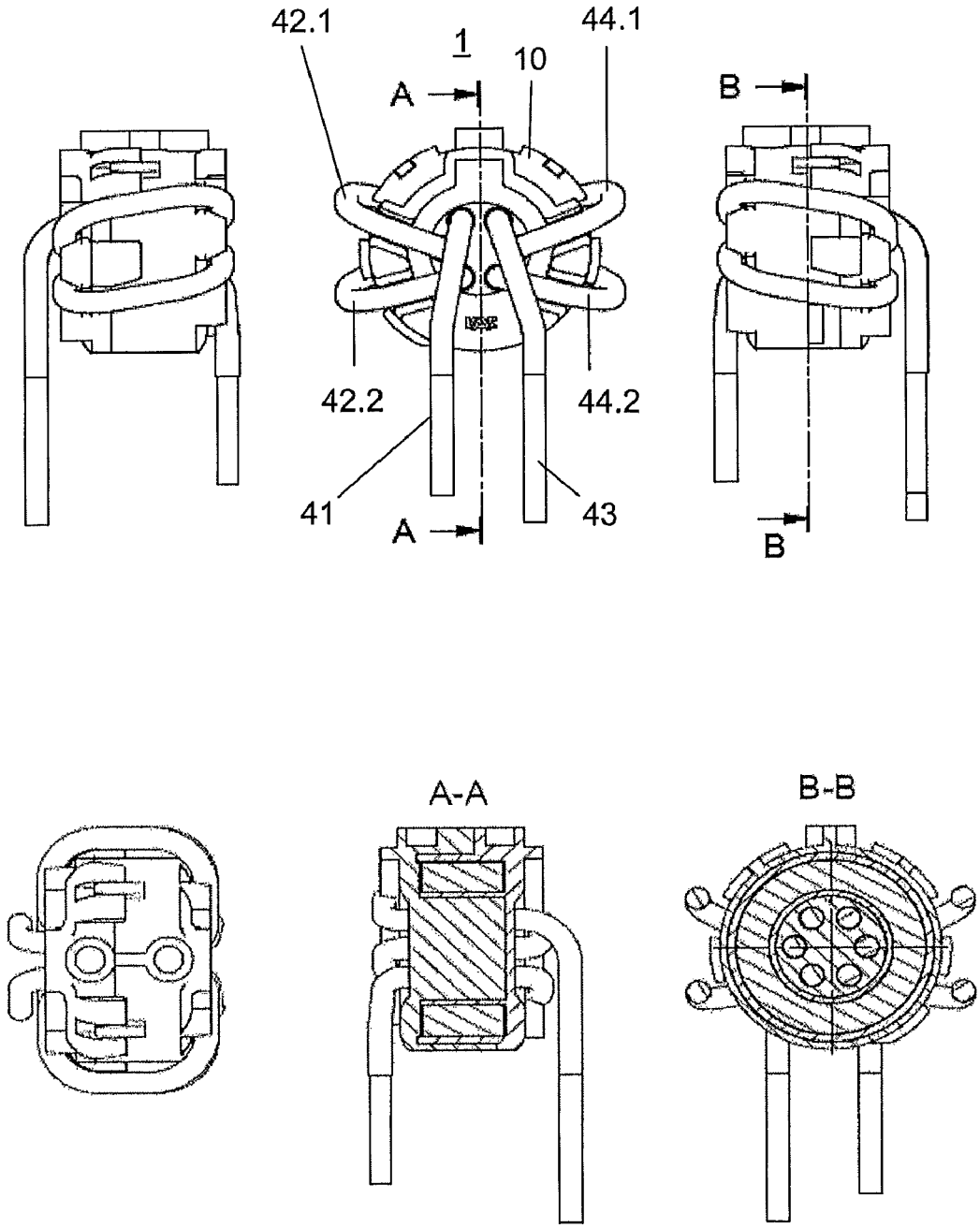

FIG. 4 shows the wound choke body 10 from FIG. 1, that is, the completed current-compensated choke 1 in various perspectives. The first half shell 11 and the non-conductive body 14 embodied in one piece thereto are shown. The holes 15.1 to 15.6 of the non-conductive body 14 can no longer be seen in FIG. 4, since they are filled with wire. Furthermore, the first coil 41 with windings 42.1 and 42.2 can be seen, as well as the second coil 43 with windings 44.1 and 44.2. The first coil 41 and the second coil 43 are designed exactly symmetrically to one another, the same applies accordingly to the windings 42.1 and 44.1 or 42.2 and 44.2 respectively corresponding to one another.

The invention having been disclosed herein with reference to certain drawings and specific embodiments, it will be understood that these are exemplary of, and not limiting of, the appended claims.

The invention claimed is:

1. A current-compensated choke comprising:

a ring core, comprising a solid ring having an outer circumference and an inner circumference surrounding an interior space;

at least a first coil and a second coil each of which are wound about the ring core, and each comprising the same number of windings of a conductor; and a non-conductive body disposed within the interior space of the ring core and provided with a first set of holes and a second set of holes, each hole extending from a first surface to a second surface of the non-conductive body, wherein each hole of the first set of holes opposes a corresponding hole of the second set of holes to form opposing pairs in a mirror symmetrical manner relative to a symmetry axis of the ring core, wherein at least one winding of the first coil passes through one hole of the first set of holes, and at least one winding of the second coil passes through one hole of the second set of holes forming an opposing pair with the hole of the winding of the first coil.

2. The current-compensated choke according to claim 1, wherein the non-conductive body comprises a disk comprising planar circular areas extending parallel to a direction in which an internal radius vector of the ring core extends.

3. The current-compensated choke according to claim 1, further comprising a plastic body assembled from at least two parts and that encloses the ring core.

4. The current-compensated choke according to claim 3, wherein the non-conductive body is connected to one of the parts of the assembled plastic body or is a component of one of the parts of the assembled plastic body.

5. The current-compensated choke according to claim 3, wherein the plastic body comprises two half shells.

6. The current-compensated choke according to claim 5, wherein the two half-shells of the plastic body overlap such that they are guided by the inner circumference and the outer circumference of the ring core during assembly.

7. The current-compensated choke according to claim 5, wherein the two half shells of the plastic body are connected to one another by an ultrasonic welded seam.

8. The current-compensated choke according to claim 5, wherein the two half shells of the plastic body each comprise threads such that the two half shells can be screwed to one another by means of the threads.

9. The current-compensated choke according to claim 5, wherein the two half shells of the plastic body are connected to one another by a locking mechanism.

10. The current-compensated choke according to claim 5, further comprising guide elements for guiding and separating the windings arranged on a surface of the plastic body, or guide elements inserted into the surface of the plastic body, or a combination thereof.

11. The current-compensated choke according to claim 10, wherein the guide elements comprise ridges, or grooves, or a combination thereof.

12. The current-compensated choke according to claim 3, wherein the plastic body comprises a high-temperature resistant plastic.

13. The current-compensated choke according to claim 1, wherein the non-conductive body has at least one insertion aid conically tapering from one surface of the non-conductive body in the direction in which the holes extend.

14. The current-compensated choke according to claim 1, wherein the ring core comprises a soft magnetic strip.

15. The current-compensated choke according to claim 14, wherein the soft magnetic strip comprises an amorphous or nanocrystalline alloy.

16. The current-compensated choke according to claim 1, wherein the ring core has an external diameter of at least 20 mm.

17. The current-compensated choke according to claim 1, wherein the first coil, or the second coil, or both, comprise copper wire.

18. The current-compensated choke according to claim 17, wherein copper wire is varnished, has a high-temperature resistant insulation, or both.

19. The current-compensated choke according to claim 17, wherein the copper wire has a diameter of more than 2 mm.

20. The current-compensated choke according to claim 1, further comprising an insulating coating of a thickness of between 10 and 200 micrometers.

21. The current-compensated choke according to claim 12, wherein the high-temperature resistant plastic comprises a polyether ether ketone (PEEK) or a polyphenylene sulfide (PPS).

22. The current-compensated choke according to claim 18, wherein the high-temperature resistant insulation comprises a polyester imide (PEI) or a polyimide (PI).

23. A method for producing a current-compensated choke, comprising:

a) providing a ring core having an interior space containing a non-conductive body disposed therein, the non-conductive body comprising a first set of holes and a second set of holes, each hole extending from a first surface to a second surface of the non-conductive body, wherein each hole of the first set of holes opposes a corresponding hole of the second set of holes to form opposed pairs in a mirror symmetrical manner relative to a symmetry axis of the ring core, wherein the holes lying on a first side of the symmetry axis form a first group and the holes lying on a second side of the symmetry axis form a second group, b) guiding a first end of a first wire section through a first hole of the first group, c) guiding a second end of the first wire section in a loop enclosing the ring core through a second hole of the first group, wherein the first end of the first wire section is guided through the first hole in a direction opposite to the direction in which the second end of the first wire section is guided through the second hole, d) guiding a first end of a second wire section through a first hole of the second group, e) guiding a second end of the second wire section in a loop enclosing the ring core through a second hole of the second group, wherein the first end of the second wire section is guided through the first hole in a direction opposite the direction in which the second end of the second wire section is guided through the second hole, f) applying a tensile force to the first wire sections after c), d), or e) and applying a tensile force to the second wire section after d) or e).

24. The method according to claim 23, wherein the tensile force is applied to the first end and the second end of each wire section.

25. The method according to claim 23, wherein the tensile force is applied after the first wire section has been guided through all of the holes one of the first group or after the second wire section has been guided through all of the holes of the second group.

26. The method according to claim 23, wherein the tensile force is applied each time an end of a wire section is guided through a further hole.

* * * * *